US005578432A

United States Patent [19]

McGuckin et al.

[11] Patent Number: 5,578,432

[45] Date of Patent: Nov. 26, 1996

[54] ADDENDA FOR AN AQUEOUS PHOTOGRAPHIC STABILIZING SOLUTION

[75] Inventors: Hugh G. McGuckin; John S. Badger; Michael W. Orem, all of Rochester, N.Y.

[73] Assignee: Eastman Kodak Company, Rochester, N.Y.

[21] Appl. No.: 619,146

[22] Filed: Mar. 21, 1996

Related U.S. Application Data

[63] Continuation of Ser. No. 300,117, Sep. 2, 1994, abandoned, which is a continuation of Ser. No. 46,340, Apr. 13, 1993, abandoned, which is a continuation-in-part of Ser. No. 881,916, May 12, 1992, abandoned.

[51] Int. Cl.[6] ..... G03C 11/06

[52] U.S. Cl. ..... 430/429; 430/372; 430/428; 430/463

[58] Field of Search ..... 430/372, 428, 430/429, 463

[56] References Cited

U.S. PATENT DOCUMENTS

| | | | |
|---|---|---|---|
| 2,618,558 | 11/1952 | Vittum et al. | 430/470 |
| 3,833,376 | 9/1974 | Newman et al. | 430/351 |
| 4,332,886 | 6/1982 | Aoki et al. | 430/551 |
| 4,696,891 | 9/1987 | Guzzi | 430/331 |
| 4,745,047 | 5/1988 | Asami et al. | 430/376 |
| 4,778,743 | 10/1988 | Ishikawa et al. | 430/428 |
| 4,786,583 | 11/1988 | Schwartz | 430/372 |
| 4,849,333 | 7/1989 | Fujita | 430/372 |
| 4,923,782 | 5/1990 | Schwartz | 430/372 |
| 5,087,554 | 2/1992 | Chari et al. | 430/541 |
| 5,104,775 | 4/1992 | Abe et al. | 430/428 |
| 5,360,700 | 11/1994 | Kawamura et al. | 430/428 |

FOREIGN PATENT DOCUMENTS

| | | | |
|---|---|---|---|
| 91308059.4 | 9/1991 | European Pat. Off. . | |
| 64-349 | 4/1985 | Japan | 430/463 |
| 217643 | 4/1987 | Japan | 430/372 |
| 250449 | 10/1987 | Japan | 430/429 |
| 244036 | 10/1988 | Japan . | |
| 300743 | 12/1990 | Japan | 430/428 |
| 155549 | 7/1991 | Japan | 430/429 |
| 25835 | 1/1992 | Japan . | |

*Primary Examiner*—Hao Van Le

*Attorney, Agent, or Firm*—Sarah Meeks Roberts; J. Lanny Tucker

[57] ABSTRACT

A stabilizing bath that provides image stability and uniform drainage of excess fluid to prevent drying spots and that reduces or eliminates the formation of residue on the base side of color negative films is comprised of hexamethylenetetramine, a nonionic polyethoxylated surfactant, and an anionic sulfate or sulfonate surfactant. The stabilizing bath is used as the final processing bath prior to drying. The nonionic surfactant provides uniform drainage of excess fluid and the anionic sulfate or sulfonate surfactant functions to reduce or eliminate the formation of residue on the base side of color negative films.

15 Claims, No Drawings

ADDENDA FOR AN AQUEOUS PHOTOGRAPHIC STABILIZING SOLUTION

This is a Continuation of U.S. Ser. No. 08/300,117, filed Sep. 2, 1994, now abandoned, which is a continuation of U.S. Ser. No. 08/046,340, filed Apr. 13, 1993, now abandoned, which in turn is a continuation-in-part of U.S. Ser. No. 07/881,916, filed May 12, 1992, now abandoned.

FIELD OF THE INVENTION

This invention relates to the field of silver halide photographic processing, and in particular to compositions of a stabilizing solution which improve the image stability and appearance of processed color negative films.

BACKGROUND OF THE INVENTION

The processing of silver halide color film generally involves the steps of color evolution, bleaching, fixing, stabilizing and drying. The stabilizing bath is used as the final step in the processing of color films in order to reduce stain and/or to enhance dye stability. The stability of the dye image is believed to be affected by the presence of unreacted coupler in the emulsion layers, because the coupler and the dye can react slowly with one another to degrade a color image. Dye stability is also believed to be influenced by temperature, humidity, air quality, and exposure to light. In particular the image from magenta dye tends to fade much more rapidly than either the cyan or the yellow dye image. The addition of a compound that releases a methylene group to a stabilizing formulation can prevent the redox degradation of the magenta coupler that would otherwise cause magenta dye fade. Stabilizing solutions are aqueous formulations that contain a compound that produces a methylene group as the key component for dye stabilization.

Typical stabilizing solutions often contain an aldehyde, in particular formaldehyde, as the methylene-releasing agent. Formaldehyde possesses the added benefit of high volatility, so that any residual formaldehyde on the base side of the film is readily removed in a drying step. However in recent years concerns over the hazardous effects of formaldehyde have stimulated the development of stabilizing solutions that do not contain hazardous components, and alternative stabilizing compositions have been formulated.

Hexamethylenetetramine (HMTA) is an acceptable substitute for some or all of the formaldehyde in the stabilizing bath. HMTA is a water-soluble, nonvolatile crystalline compound with superior methylene-releasing properties. HMTA does not release significant levels of formaldehyde into solution or as vapor at the pH of the stabilizer solution (~pH 7 to 9). However, color negative films processed in machines that provide minimal or no squeegeeing of the film after stabilization in a HMTA-containing stabilizing bath will exhibit an objectionable residue on the base side of the film upon drying. This residue contains significant amounts of HMTA.

A laid open Japanese patent application from Konica Corporation (63/244,036) has described the use of a stabilizing solution consisting of a sulfite-ion releasing compound, and at least one of the following surfactants: anionic surfactant of the alkyl polyalklyeneoxides or alkyl arylpolyalkyleneoxides containing sulfate or phosphate groups, nonionic hydrocarbon polyalklyeneoxide surfactants, or a water-soluble organic siloxane type compound. The application suggests that such a formulation can be useful in preventing the adherence of crystals which form on the surface of the stabilizing bath.

A second laid open Japanese application from Konica (40/25,835) has disclosed the use of an HMTA-containing stabilizing solution containing at least one of the following surfactants: anionic polyalkyleneoxide sulfates or phosphates, nonionic polyalkyleneoxide alcohols or water soluble organic siloxane compounds.

It is the object of the present invention to provide a stabilizer solution containing HMTA that significantly reduces or completely eliminates observable residue on the base side of the color negative film, and which can be dried without forming drying marks or spots.

SUMMARY OF THE INVENTION

In one aspect of this invention an aqueous photographic stabilizing solution containing the dye stabilizing agent hexamethylenetetramine for use in the color processing of photographic elements is provided with chemical addenda for the purpose of avoiding the formation of drying marks or spots, and reducing or eliminating formation of a residue on the base side surface of color negative film, wherein said chemical addenda are a nonionic polyethoxylated surfactant and an anionic sulfate or sulfonate surfactant.

In preferred embodiments the nonionic polyethoxylated surfactants have the general formula $R_1$—$(B)_x$—$(E)_m$—D, wherein $R_1$ is an alkyl group with 8–20 carbons, B is a phenyl group and x is 0 or 1, E is —$(OCH_2CH_2)$— and m is 6–20, and D is —OH or —$OCH_3$. Most preferably the nonionic surfactant is tridecylpolyethyleneoxide(12)alcohol (trade name "Renex 30", available from ICI). Another most preferred nonionic surfactant is octylphenoxypolyethyleneoxide(11–12)ethanol (trade name "Triton X-102").

In preferred embodiments the nonionic polyethoxylated surfactant is present at a working concentration of approximately 0.1 to 0.5 g/L. In some embodiments the nonionic polyethoxylated surfactant is present at a working concentration of 0.2 g/L.

In one preferred embodiment the anionic sulfate or sulfonate surfactants have the general formula $R_2$—(A)—C, wherein $R_2$ is an alkyl group with 8–20 carbons and more preferably 10–16 carbons, A is an aryl or a hydroxy ethylene group, and C is $SO_3^-M^+$ or $SO_4^-M^+$wherein $M^+$ is ammonium or an alkali metal such as $K^+$, $Na^+$, $Li^+$. Most preferably the anionic surfactant is sodium dodecylbenzenesulfonate (trade name "Siponate DS-10", available from Rhone-Poulenc) or sodium 2-hydroxy-tetra-, and hexa, -decane-1-sulfonate (trade name "Witconate AOS", available from Witco).

In another preferred embodiment the anionic sulfate or sulfonate surfactants have the general formula $(R_3)_n$—$(B)_x$—$(E)_y$—C, wherein $R_3$ is an alkyl group with 4–20 carbons and more preferably 4–16 carbons, n is 1 when x is 0, and n is 1, 2, or 3 when x is 1, B is a phenyl group and x is 0 or 1, E is —$(OCH_2CH_2)$— and y is an integer from 1 to 8, and C is $SO_3^-M^+$ or $SO_4^-M^+$ wherein $M^+$ is ammonium or an alkali metal such as $K^+$, $Na^+$, and $Li^+$. Examples of suitable anionic sulfate or sulfonate surfactant are sodium tributylphenoxypolyethyleneoxidesulfate (trade name "Hostapal BV", available from Hoechst Celanese), or sodium alkyl($C_{12}$–$C_{15}$)polyethyleneoxide(5)sulfate (trade name "Witcolate SE-5" available from Witco), or sodium alkyl($C_9$–$C_{12}$)polyethyleneoxide(7)ethanesulfonate (trade name "Avanel S-70", available from PPG).

In preferred embodiments the anionic sulfate or sulfonate surfactant is present at a working concentration of approximately 0.05 to 1.0 g/L. More preferably, the anionic sulfate or sulfonate surfactant is present at a working concentration of approximately 0.1 to 0.5 g/L. Most preferably, the anionic sulfate or sulfonate surfactant is present at a working concentration of 0.2 g/L.

DESCRIPTION OF THE PREFERRED EMBODIMENTS

The invention provides an aqueous photographic stabilizing solution containing the dye stabilizing agent HMTA that has the desirable properties of providing superior image stability, while avoiding the formation of drying marks or spots, and reducing or eliminating the formation of residue on the film that is associated with HMTA.

The invention has identified chemical addenda for use in an aqueous photographic stabilizing solution that are commercially available and environmentally safe. An HMTA-containing stabilizing solution that further includes a nonionic hydrocarbon polyethoxylated surfactant and an anionic sulfate or sulfonate surfactant has the advantage that it can be utilized in any processing method and is especially useful in avoiding the formation of drying marks or spots and in reducing or eliminating residue from color negative film, particularly when the film has been processed in a rack and tank machine that does not rinse or squeegee the film prior to drying. A stabilizing solution containing a nonionic hydrocarbon polyethoxylated surfactant has the desired uniform draining behavior so that drying marks are not formed. A stabilizing solution also containing an anionic sulfate or sulfonate surfactant has the additional desired property of reducing or eliminating the formation of residue on the base side of the film.

An aqueous stabilizing solution utilized in rack and tank and in other types of processing machines contains a dye stabilizing agent (formaldehyde) and a wetting agent. The use of a stabilizer solution which substitutes HMTA for formaldehyde can result in the formation of a residue on the base side of the processed film. Several general types of chemical addenda were tested for their ability to reduce or eliminate residue formation on color negative film in a HMTA containing formula. These addenda included polymers, dispersants, and cationic, anionic and non-ionic surfactants. Over 100 chemicals were tested for their usefulness in reducing residue formation.

The efficacy of potential chemical addenda in reducing or eliminating the formation of residue on color negative film was initially analyzed by adding 0.1–3.0 g/L of each chemical addenda separately to an aliquot of a standard aqueous stabilizing composition and drying a portion of the mixture on a glass microscope slide to simulate the conditions of a standard rack and tank machine that dries film immediately after the stabilizing step. Briefly, the mixture was coated onto the glass slide, allowed to drain, and then the adherent mixture was dried with a warm air blower. The slide was then viewed under a microscope (~50×magnification) and the extent of residue formation was determined.

TEST 1

Promising chemical addenda were further tested in a PAKO, model HTC rack and tank processing machine for efficacy in eliminating the formation of residue on the base side surface of color negative films.

The processing steps were as follows: 1) color development (~100° F.), 2) bleach, 3) wash, 4) fix, 5) wash, 6) stabilize and dry (~110° F. to 120° F.). The recommended KODAK color developer, bleach and fix for the C-41 process were utilized. The stabilizing bath (our standard solution) contained 5.0 g/L HMTA, 0.20 g/L tridecylpolyethyleneoxide(12)alcohol (RENEX 30), a biocide, and a hydrolyzed polymaleic anhydride polymer for calcium ion control. Each anionic surfactant to be tested was added to this solution at a concentration of 0.2 g/L, respectively. Three strips of color negative film (Kodacolor Gold 100), 35 mm×13", were processed for each stabilizer with addenda. As a control, three strips of film were also processed using the above stabilizer solution without the added anionic surfactant.

After processing, each film strip was evaluated for residue by viewing the base side of each strip under a specular light (a Cambridge halogen microscope source) that was held approximately 8 inches from the film. The amount of residue observed was rated on a scale of 1 to 4; wherein a rating of 1 signifies no residue observed; a rating of 2 signifies noticeable residue easily observed under specular light; a rating of 3 signifies noticeable residue easily observed under normal room lighting; a rating of 4 signifies a very noticeable, heavy deposit of residue observed under normal room lighting. The control film strips were given the rating 2, as they had noticeable residue under specular light. Several anionic surfactants were found to be very effective for reducing or eliminating the residue on the base side of the color negative film. Anionic surfactants that were given the rating 1 for no visible residue included sodium dodecylbenzenesulfonate (available from Rhone-Poulenc, trade name "Siponate DS-10"), sodium 2-hydroxy-tetra-, and-hexa, -decane-1-sulfonate (available from Witco, trade name "Witconate AOS"), sodium tributylphenoxypolyethyleneoxidesulfate (trade name "Hostapal BV", available from Hoechst Celanese), sodium alkyl($C_{12}$–$C_{15}$)polyethyleneoxide(5)sulfate (trade name "Witcolate SE-5", available from Witco), sodium alkyl($C_9$–$C_{12}$)polyethyleneoxide(7)ethanesulfonate (trade name "Avanel S-70", available from PPG).

TEST 2

Stabilizing solutions containing an anionic surfactant were evaluated for efficacy in reducing film base residue and water spotting, both with and without a nonionic surfactant.

Film processing was carried out using a PAKO (Model HTC) rack and tank processing machine as described above in Test 1. The processing steps were as follows: 1) color development (ca. 100° F.); 2) bleach; 3) wash; 4) fix; 5) wash; 6) stabilize; and dry (ca. 110° F. to 120° F.). The recommended KODAK C-41 color developer, bleach, fix and processing conditions for Kodacolor films were utilized. Three strips of exposed Kodacolor Gold film 100 film, 35 mm×13"(33 cm), were processed with each solution.

The stabilizing bath was formulated as follows:

| Stabilizing bath: | |
|---|---|
| hexamethylenetetramine (HMTA) | 5.0 g/L |
| hydrolyzed polymaleic anhydride polymer (Irgaform 3000) | 0.05 g/L |
| 1,2-benzisothiazoline-3-one (Proxel GXL) | 60 ppm |
| anionic surfactant (if present) | 0.2–0.6 g/L |
| nonionic surfactant (if present) | 0.0–0.2 g/L |

After processing, the samples were evaluated for residue as described in Test 1. The amount of residue on each strip was judged by two observers using the scale (1–4) employed in Test 1. Table 1 lists the results for a variety of anionic and nonionic surfactants used alone and in combination. The rating listed for each solution is an average based on the results from three film strips.

TABLE 1

Comparative results for single and mixed surfactant stabilizing solutions.

| | surfactant | | | | | |
|---|---|---|---|---|---|---|
| no. | anionic | g/L | nonionic | g/L | rating | observation |
| 1 | Siponate DS-10 | 0.2 | — | — | 2–3 | spots |
| 2 | Siporate DS-10 | 0.4 | — | — | 2–3 | spots |
| 3 | Siponate DS-10 | 0.6 | — | — | 2–3 | spots |
| 4 | — | — | Renex 30 | 0.2 | 2–3 | |
| 5 | Siponate DS-10 | 0.2 | Renex 30 | 0.2 | 1 | |
| 6 | Siponate DS-10 | 0.2 | TritonX-102 | 0.2 | 1 | |
| 7 | Witcolate SE-5 | 0.2 | — | — | 2–3 | spots |
| 8 | Witcolate SE-5 | 0.4 | — | — | 2–3 | spots |
| 9 | Witcolate SE-5 | 0.6 | — | — | 3 | spots |
| 10 | Witcolate SE-5 | 0.2 | Renex 30 | 0.2 | 1 | |
| 11 | Witcolate SE-5 | 0.4 | Renex 30 | 0.2 | 1 | |
| 12 | Witcolate 1075x* | 0.2 | — | — | 2–3 | spots |
| 13 | Witcolate 1075x* | 0.4 | — | — | 3 | spots |
| 14 | Witcolate 1075x* | 0.6 | — | — | 2–3 | spots |
| 15 | Witcolate 1075x* | 0.2 | Renex 30 | 0.2 | 1 | |

*Witcolate 1075x = ammonium nonylphenoxypolyethyleneoxidesulfate

Referring to Table 1, water spotting was observed on those film samples treated in the stabilizing bath which contained only an anionic surfactant, such as Witcolate 1075x, Witcolate SE-5 and Siponate DS-10 (see, nos. 1–3, 7–9, and 11–14). These spots appeared as a crystalline residue on the base side of the film. When these same anionic surfactants were combined in solution with the polyethoxylated nonionic surfactants, such as Renex 30 and Triton X-102, both uniform drying (no water spots) and no observable residue were noted (see, nos. 5, 6, 10 and 11). Nonionic surfactants alone, such as no. 4, were sufficient to eliminate water spotting, but received an inferior rating because of observable residue.

What is claimed is:

1. An aqueous photographic stabilizing solution for use in the color processing of photographic elements, comprising:

hexamethylenetetramine;

approximately 0.1 to 0.5 g/l of a nonionic polyethoxylated surfactant having the chemical formula $$R_1—(B)_x—(E)_m—D,$$

wherein $R_1$ is an alkyl group with 8 to 20 carbons,

B is a phenyl group and x is 0 or 1,

E is $—(OCH_2CH_2)—$ and m is 6 to 20, and

D is —OH or $—OCH_3$; and approximately 0.05 to 1.0 g/l of an anionic surfactant having the chemical formula $$R_2—(A)—C,$$

wherein $R_2$ is an alkyl group having 8 to 20 carbon atoms,

A is selected from the group including a phenyl group and an hydroxyethylene group, and C is selected from the group including $SO_3—M^+$ and $SO_4—M^+$, and $M^+$ is selected from the group including $NH4^+$, and the alkali metals $Na^+$, $K^+$, and $Li^+$.

2. The stabilizing solution of claim 1, wherein said nonionic surfactant is tridecylpolyethyleneoxide(12)alcohol.

3. The stabilizing solution of claim 1, wherein said anionic surfactant is sodium dodecylbenzenesulfonate.

4. The stabilizing solution of claim 1, wherein said nonionic surfactant is octylphenoxypolyetheneoxide(11–12)ethanol.

5. The stabilizing solution of claim 4, wherein said anionic surfactant is sodium dodecylbenzenesulfonate.

6. An aqueous photographic stabilizing solution for use in the color processing of photographic elements, comprising:

hexamethylenetetramine;

approximately 0 to 0.5 g/l of a nonionic polyethoxylated surfactant having the chemical formula $$R_1—(B)_x—(E)_m—D,$$

wherein $R_1$ is an alkyl group with 8 to 20 carbons,

B is a phenyl group and x is 0 or 1,

E is $—(OCH_2CH_2)—$ and m is 6 to 20, and

D is —OH or $—OCH^3$; and approximately 0.05 to 1.0 g/l of an anionic surfactant having the chemical formula $$(R_3)_n—(B)_x—(E)_y—C$$

wherein $R_3$ is an alkyl group having 4 to 20 carbon atoms, n is 1 when x is 0, and n is 1, 2, or 3 when x is 1, B is a phenyl group and x is 0 or 1, E is a $—(OCH_2CH_2)—$ group and y is an integer from 1 to 8, and C is selected from the group including $SO_3—M^+$ and $SO_4—M^+$, and $M^+$ is selected from the group including $NH4^+$, and the alkali metals $Na^+$, $K^+$, and $Li^+$.

7. The stabilizing solution of claim 6, wherein said nonionic surfactant is tridecylpolyethyleneoxide(12)alcohol.

8. The stabilizing solution of claim 6, wherein said nonionic surfactant is octylphenoxypolyetheneoxide(11–12)ethanol.

9. The stabilizing solution of claim 6, wherein said anionic surfactant is sodium alkyl(C12–C15)polyethyleneoxide(5)-sulfate.

10. The stabilizing solution of claim 8, wherein said anionic surfactant is sodium alkyl(C12–C15)polyethyleneoxide(5)-sulfate.

11. The stabilizing solution of claim 1 wherein A is a phenyl group.

12. An aqueous photographic stabilizing solution for use in the color processing of photographic elements, comprising:

hexamethylenetetramine, a nonionic polyethoxylated surfactant that is present in an amount of from 0.1 to 0.5 g/l, the nonionic polyethoxylated surfactant being either tridecylpolyethyleneoxide(12)alcohol or octylphenoxypolyetheneoxide(11–12)ethanol, and an anionic surfactant that is present in an amount of from 0.05 to 1 g/l, the anionic surfactant being either sodium dodecylbenzenesulfonate or sodium alkyl(C12–C15)polyethyleneoxide(5) sulfate.

13. The solution of claim 12 wherein each of said nonionic and anionic surfactants is present in an amount of about 0.2 g/l.

14. The solution of claim 1 wherein said anionic surfactant is present in an amount of from about 0.1 to about 0.5 g/l.

15. The solution of claim 6 wherein said anionic surfactant is present in an amount of from about 0.1 to about 0.5 g/l.

* * * * *

UNITED STATES PATENT AND TRADEMARK OFFICE

CERTIFICATE OF CORRECTION

PATENT NO. : 5,578,432

DATED : November 26, 1996

INVENTOR(S) : McGuckin, et al

It is certified that error appears in the above-indentified patent and that said Letters Patent is hereby corrected as shown below:

Column 6, line 42, "0" should read -- 0.1 --.

Signed and Sealed this

Fourth Day of March, 1997

*Attest:*

*Attesting Officer*

BRUCE LEHMAN

*Commissioner of Patents and Trademarks*